United States Patent [19]

Perry

[11] Patent Number: 4,936,708

[45] Date of Patent: Jun. 26, 1990

[54] APPARATUS FOR DIRECTING FORWARD MOVEMENT OF A ROD

[76] Inventor: Robert G. Perry, 1259 Hatfield Dr., Evansville, Ind. 47715

[21] Appl. No.: 415,642

[22] Filed: Oct. 2, 1989

[51] Int. Cl.[5] ..... F16L 1/02; E21B 7/26; E21B 11/02

[52] U.S. Cl. ..... 405/184; 175/23

[58] Field of Search ..... 405/154, 159, 174, 175, 405/184; 175/23, 321

[56] References Cited

U.S. PATENT DOCUMENTS

| | | | |
|---|---|---|---|
| 955,729 | 4/1910 | Welsh | 175/23 |
| 2,283,650 | 5/1942 | Sanborn | 175/23 X |
| 4,787,463 | 11/1988 | Geller et al. | 405/184 X |

FOREIGN PATENT DOCUMENTS

| | | | |
|---|---|---|---|
| 407614 | 12/1924 | Fed. Rep. of Germany | 175/23 |
| 3306046 | 8/1984 | Fed. Rep. of Germany | 405/154 |
| 3306070 | 8/1984 | Fed. Rep. of Germany | 405/154 |
| 519776 | 6/1921 | France | 175/23 |
| 23342 | of 1912 | United Kingdom | 175/23 |

*Primary Examiner*—Dave W. Arola
*Assistant Examiner*—John A. Ricci
*Attorney, Agent, or Firm*—Barnes & Thornburg

[57] ABSTRACT

An apparatus for directing the forward movement of a rod as it is moved through a loose medium has the versatility either to direct or not direct such movement. The apparatus has a directing member that is disabled in a first position wherein movement of the rod is not directed and is enabled in a second position wherein movement of the rod is directed. The apparatus includes drive-engaging members and a control mechanism for controlling the disengagement and engagement of the drive-engaging members selectively to permit forward movement of the rod in a desired direction. The apparatus may also include fluid passageways and valves for dispensing fluid such as water or drilling mud into the loose medium in the direction of movement to facilitate the movement.

20 Claims, 3 Drawing Sheets

APPARATUS FOR DIRECTING FORWARD MOVEMENT OF A ROD

BACKGROUND AND SUMMARY OF THE INVENTION

The present invention relates to apparatus employed to direct forward movement of a rod as it is pushed through a loose medium such as the ground. More particularly, the present invention relates to a directing apparatus having the versatility to direct or not to direct the movement to increase the efficiency of the movement. For convenience, the term "rod" as used herein refers to both a solid shaft or a hollow pipe and is not intended to be limited to any particular type of rod or pipe.

It is well known to push a rod through the ground from one location to another predetermined location beneath the surface of the ground. For example, a rod may be pushed under a road from one side of the road to the other side without creating a trench in the road. As a rod is pushed through a loose medium such as the ground, it encounters variations in density of the medium and may encounter obstacles which cause the rod to deviate from the intended course or path which would result in it arriving at its predetermined destination. It is therefore necessary to correct the forward movement of the rod to bring it back onto the course of movement needed to have the rod arrive at its predetermined destination.

Generally speaking, apparatus for directing forward movement of a rod through a loose medium such as the ground beneath the surface of the ground are known in the art. Typically, these known devices have a directional tip which is fixed in a directing position such that the forward movement of the rod is continuously being directed. In these prior devices, there is no way to disengage or disable the directional feature without removing the entire rod from the ground and removing the directing apparatus from the end of the rod. The removal of a long length of rod from the ground and reinsertion is a time-consuming operation. Therefore, when these prior devices are used, the operator of the pushing apparatus must continuously change direction of the movement of the rod in order to try to effect movement of the rod along a desired path or course. Because the rod is continuously being directed, the continuous changes result in a zig-zag pattern of movement as the rod is pushed through the ground.

As will become apparent from the following disclosure, the apparatus of the present invention includes various features which provide the versatility of either directing the forward movement of the rod or not directing such movement to improve the efficiency of the overall operation of pushing rod through a loose medium such as the ground.

One object of the present invention is to provide an apparatus for directing forward movement of a rod having both the capability of directing the forward movement of the rod or not directing the forward movement of the rod.

Another object of the present invention is to provide an apparatus for directing the forward movement of a rod which permits the rod to be pushed in a straight direction or in a plurality of directions other than the straight direction without withdrawing the rod from the ground and removing the directing apparatus from the end of the rod. Accordingly, the apparatus of the present invention improves the efficiency of movement of the rod along a desired course or path required for the rod to arrive at its predetermined destination.

It is a further object of the present invention to provide a way to direct a fluid such as water or drilling mud into the loose medium in the direction of the forward movement of a rod to condition the loose medium in front of the rod and thereby facilitate the movement of the rod.

According to the present invention, an apparatus for directing the forward movement of a rod as it is moved through a loose medium includes a first member having a proximal end and a distal end, a second member sleeved onto the first member so that the first member is movable relative to the second member, the second member also having a proximal end and a distal end, a directing member provided on either the first member or the second member but in the preferred embodiment, provided on the first member, a connector for coupling the proximal end of the first member to the rod, drive-engaging means on both the first and second members which cooperate to provide driving engagement between the first and second members wherein the directing member is disabled in a first driving position and the directing member is enabled in a second directing position and control means for controlling the disengagement and engagement of the drive-engaging means selectively to permit forward movement of the rod in a desired direction as the rod is being moved through the loose medium.

A further feature of the present invention is that the apparatus for directing forward movement of the rod further includes a first fluid passageway in the first member for transmitting fluid from the proximal end of the first member to the distal end of the first member, a first nozzle means for dispensing the fluid into the loose medium in the direction of the forward movement of the rod when the directing member is disabled, and a second nozzle means for dispensing fluid into the loose medium in the direction of forward movement of the rod when the directing member is enabled. In the preferred embodiment, the first nozzle means includes a first valve means for closing the first nozzle means when the directing member is enabled and for opening the first nozzle means when the directing member is disabled. Further, the second nozzle means includes a second valve means for closing the second nozzle means when the directing member is disenabled and for opening the second nozzle means when the directing member is enabled. The first valve means includes a sealing means and bypass means for bypassing the sealing means when the directing member is disabled.

Other objects, features, and advantages of the present invention will become apparent to those skilled in the art from the following detailed description of preferred embodiments thereof exemplifying the best mode of carrying out the invention as presently perceived.

BRIEF DESCRIPTION OF THE DRAWINGS

The detailed description particularly refers to the accompanying figures in which.

DETAILED DESCRIPTION

In general, the apparatus of the present invention has a high degree of versatility and efficiency otherwise not associated with conventional rod-directing apparatus. As will be described in more detail hereinafter, use of the present invention permits the operator to push a rod selectively in a straight direction or in a plurality of desired directions other than the straight direction without removing the rod from the loose medium through which it is being moved.

Figure 1:
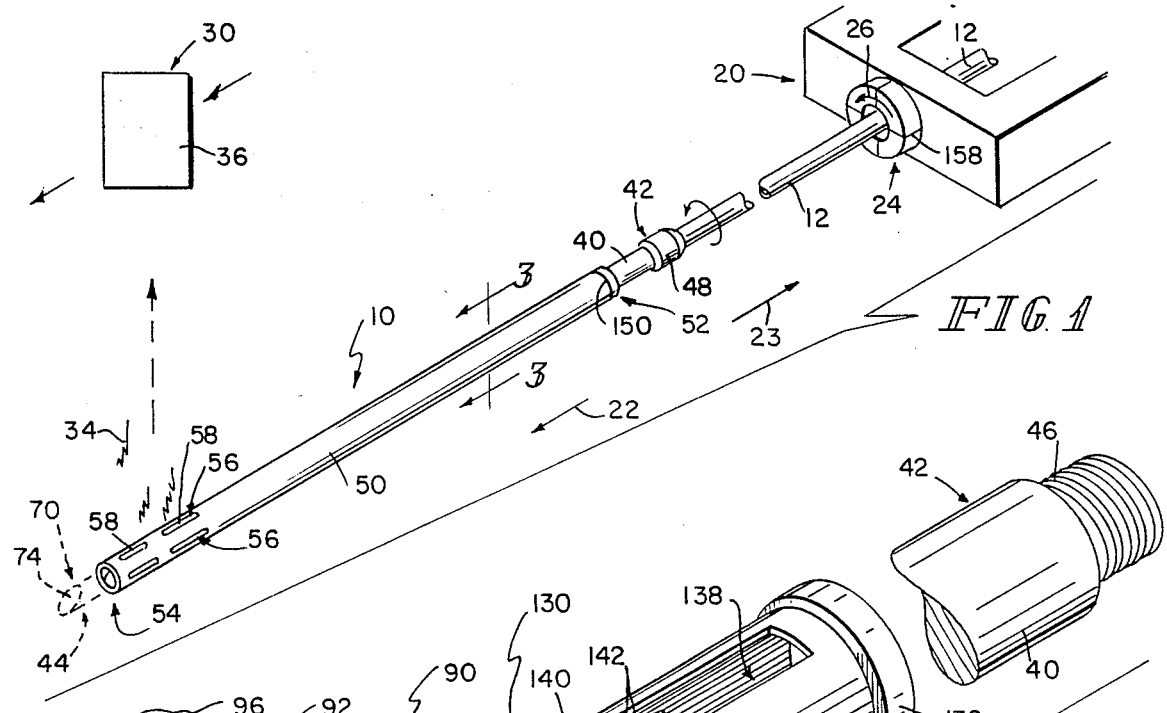
FIG. 1 is a perspective view of the apparatus for directing forward movement of a rod through a loose medium constructed according to the present invention.

Referring now to FIG. 1, there is shown an apparatus 10 for directing the forward movement of a rod 12 as it is moved through a loose medium such as the ground (not shown) beneath the surface of the medium. The rod 12 is typically pushed through the ground using a rod pusher or presser 20 to cause forward movement 22 of the rod 12. These rod pushers or pressers 20 also are capable of rearward movement 23 of the rod 12. The rod pusher or presser 20 may be of the type disclosed in U.S. Pat. No. 4,368,873, issued Jan. 18, 1983, and entitled VEHICULAR MOUNTED PIPE PRESSER or it may be of the type identified as Model P40 or P80 Rod Pusher, manufactured by The Charles Machine Works, Inc., Perry, Oklahoma.

It is known to employ a power-driven apparatus 24 for rotating the rod 12 in a counterclockwise direction 26 or a clockwise direction (not shown). For example, a power-driven apparatus of the type disclosed in U.S. Pat. No. 4,333,365, issued June 8, 1982, and entitled POWER PIPE TONGS, may be employed for rotating the rod 12. The power-driven apparatus 24 may either be mounted on the rod pusher 20 or provided separately from the rod pusher 20.

It should be understood that the present invention is also adaptable to other well-known pipe-handling mechanisms and apparatus for rotating the rod 12, and therefore, its use and operation is not intended to be limited to the particular pipe-handling mechanism 20 and power-driven apparatus 24 shown in FIG. 1 or the type described above for illustrative purposes. Specifically, the rod 12 may be manually rotated by using a wrench or other hand-held device for gripping the pipe or, in some instances, rotated simply by hand. Any pipe-handling mechanism or pipe-rotating device could be employed without departing from the scope of the present invention.

When a rod 12 is Pushed through the ground, the operator of the pipe pusher 20 is usually pushing the rod 12 to a predetermined location where the rod 12 is supposed to exit from the ground. In order to exit at the predetermined location, the rod 12 must follow a particular course or path through the ground. In order to know whether the rod 12 is moving along the desired course or path, it is necessary to monitor the forward movement 22 of the rod 12 through the ground. For this Purpose, it is well known to employ a locating system 30 such as the model RD300 transmitter locator sold by The Charles Machine Works, Inc., Perry, Oklahoma. These locating systems 30 include a transmitter 32 (see FIG. 4) located on or in the distal end of the rod 12 for transmitting a signal 34 from beneath the surface of the ground to a receiver 36 above the surface of the ground. These locating systems 30 work to various depths and give the operator both the location and depth of the rod 12.

Continuing to refer to FIG. 1, the rod-directing apparatus 10 of the present invention includes a first member 40 which is an elongated shaft having a proximal end 42 and a distal end 44. The proximal end 42 includes threads 46 (see FIG. 2) for coupling the first member 40 to the rod 12. The rod 12 also includes threads (not shown). A coupler 48 having internal threads (not shown) is used to connect the first member 40 to the rod 12.

The rod-directing apparatus 10 of the present invention also includes a second member 50 which is an elongated hollow pipe having a proximal end 52 and a distal end 54. The second member 50 is sleeved onto the first member 40 so that the first member 40 is slidably received in the second member 50. As will be explained later, the first member 40 is movable relative to the second member 50 in response to both forward movement 22 and rearward movement 23 of the rod 12. In the illustrative embodiment, both the first member 40 and the second member 50 are shown to be cylindrical, but it should be understood that the members 40, 50 do not need to be cylindrical and could be another shape without departing from the scope of the present invention.

One or more elongated slots 56 may be cut in the wall of the second member 50 to facilitate passage of the signals 34 from the transmitter 32 through the second member 50. The slots 56 are filled with a signal transmitting material 58 which will permit signals generated by the transmitter 32 to pass through it. Such material could be a plastic or epoxy material. The slots 56 are filled to prevent the loose medium from clogging the slots 56 as the rod 12 is pushed through the ground. In the preferred embodiment, the first member 40 and the second member 50 are constructed from steel. The steel could be a stainless steel or could be coated with a non-corrosive coating to prevent corrosion from moisture in the ground. However, it will be understood that the composition of the first and second members 40, 50 is not a feature of the present invention and that any strong non-corrosive material could be used without departing from the scope of the present invention.

Referring to FIGS. 1 and 4–6, the distal end 44 of the first member 40 has a cavity 60 formed therein and an opening 62 communicating with the cavity 60 for placement and location of the transmitter 32. The opening 62 is internally threaded (not shown) for attaching a directing member 70 to the distal end 44 of the first member 40. The directing member 70 includes a threaded portion 72 for attaching the directing member 70 to the distal end 44 of the first member 40. The directing member 70 is generally cylindrical and is cut diagonally to provide a sloped or inclined surface 74 which is generally elliptical in shape. In operation, the sloped surface 74 engages the loose medium or ground 76 to direct the rod-directing apparatus 10 and rod 12 in the direction of the slope of the surface 74 in response to forward movement 22 of the rod 12.

Figure 2:
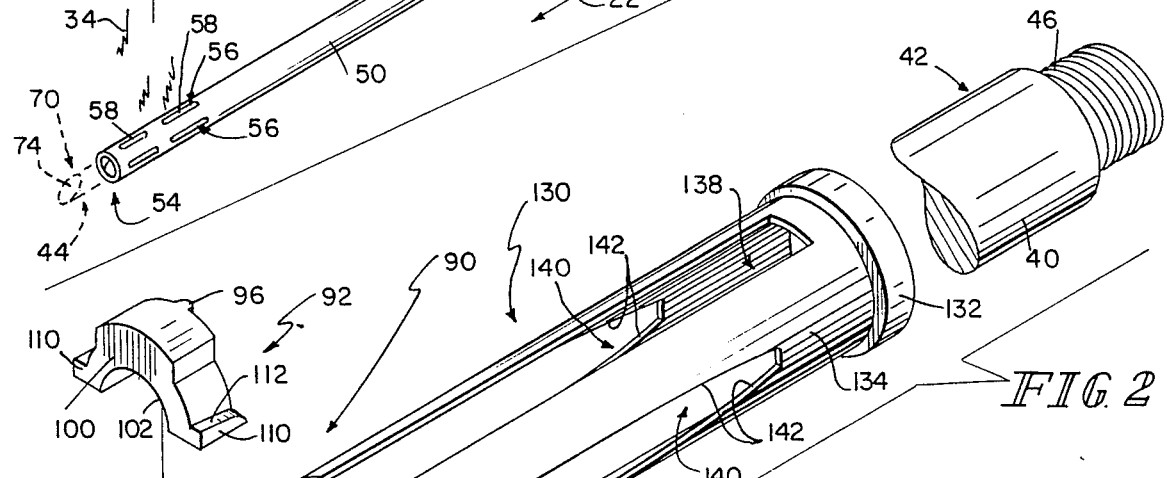
FIG. 2 is an exploded fragmentary view of the apparatus shown in FIG. 1 showing in detail the drive-engaging and control assemblies of the present invention.
Figure 3:
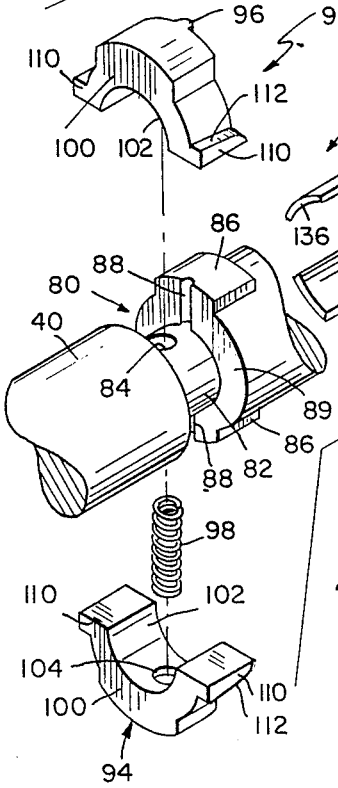
FIG. 3 is a cross-sectional view of the apparatus shown in FIG. 1 taken generally along section lines 3—3 of FIG. 1.
Figure 3:
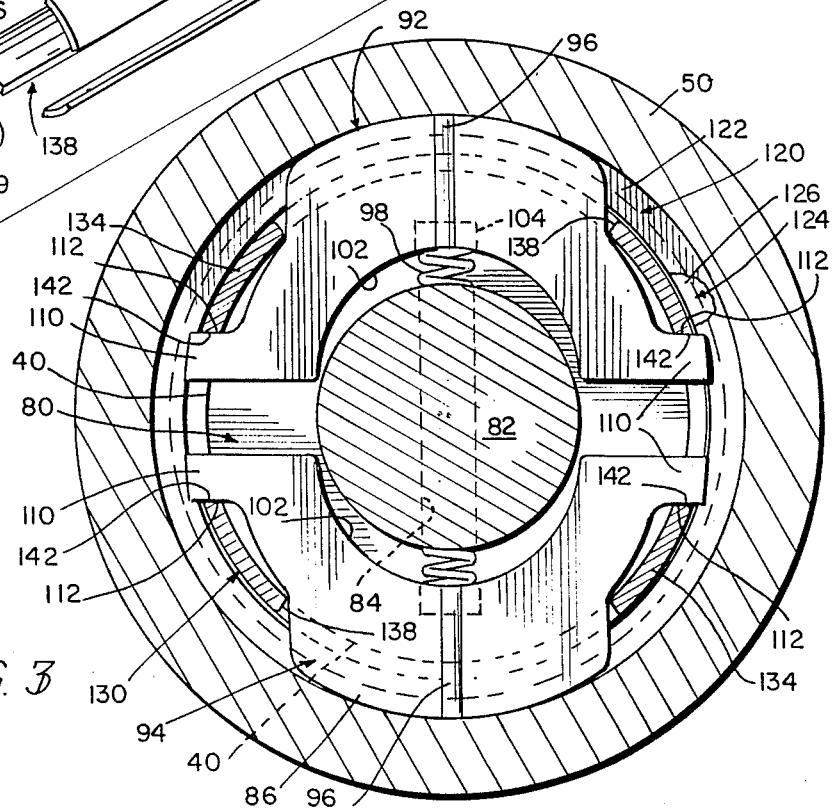

Referring to FIGS. 2 and 3, a radially outwardly opening chamber 80 is formed in the first member 40 for receiving a drive assembly 90. The chamber 80 is generally cylindrical and includes a reduced portion 82 of the first member 40. A bore 84 is formed in the reduced portion 82 of the first member 40. Two bosses 86 are provided on the external surface of the first member 40 adjacent the chamber 80 in diametrically opposed relationship. Two keyways 88 are formed in a wall 89 of the chamber 80 and extend radially outwardly through the bosses 86.

The drive assembly 90 includes two drive shoulders 92, 94 positioned in the chamber 80. Each drive shoulder 92, 94 includes an elongated key 96 which is received in one of the keyways 88 to align the drive shoulders 92, 94 in the chamber 80. The drive shoulders 92, 94 are biased radially outwardly from the chamber 80 by one or more helical springs 98 which are contained in the bore 84 in the reduced portion 82 of the first member 40.

Each of the drive shoulders 92, 94 includes an axially facing side wall 100 on the opposite side of the key 96 providing an axially facing drive surface. Each drive shoulder 92, 94 also includes an arcuate bottom surface 102 having a substantially semicircular shape to receive the reduced portion 82 of the first member 40 when the drive shoulders 92, 94 are compressed against the spring 98 into the chamber 80. The arcuate surfaces 102 include a retainer cup 104 for retaining the spring 98. Each drive shoulder 92, 94 includes two cam followers 110 on opposite sides of the drive shoulder 92, 94. The cam followers 110 extend radially outwardly providing cam surfaces 112 which are slightly inclined or sloped as shown in FIG. 2.

Figure 4:
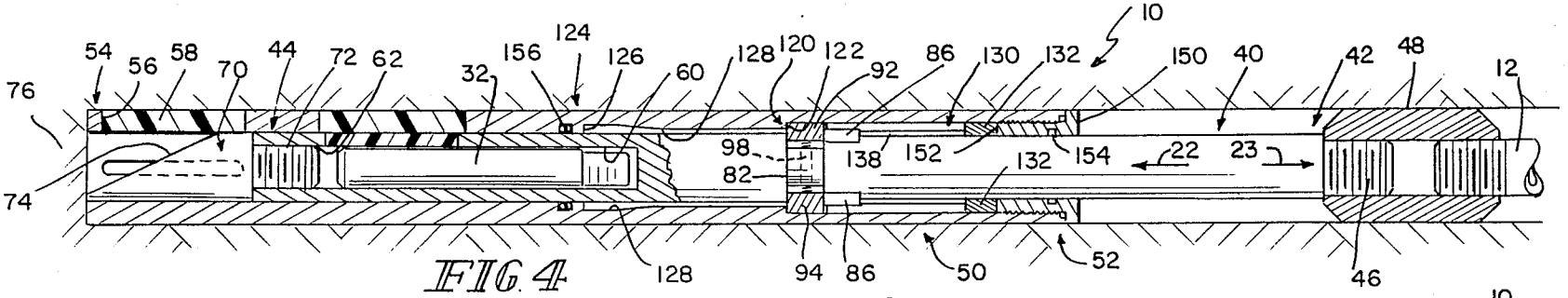
FIG. 4 is a longitudinal transverse view of the apparatus shown in FIG. 1 showing the directing member of the apparatus in its disabled position.

Referring now to particularly to FIG. 3, the second member 50 has formed on its inner surface an annular ridge 120 providing an axially facing drive face 122. The second member 50 also has formed on its inner surface another annular ridge 124 in longitudinal spaced relationship to the annular ridge 120. Annular ridge 124 provides another axially facing drive face 126 on the inner surface of second member 50. As shown in FIGS. 3 and 4, annular ridge 120 is closest to the proximal end 52 of second member 50 and annular ridge 124 is spaced longitudinally therefrom in the direction of the distal end 54. Further, a ramp 128 is provided on the inner surface of the second member 50 between the ridges 120 and 124. The ramp 128 extends radially inwardly from a radially outer point of ridge 124 to a radially inner point of ridge 120 as shown in FIG. 4. The purpose of ramp 128 will become apparent in the description of the operation of apparatus 10.

The drive shoulders 92, 94 are biased radially outwardly from the first member 40 by spring 98 toward the inner surface of second member 50 to engage the drive faces 122 and 126. When drive shoulders 92, 94 are engaging a drive face 122, 126, the second member 50 is driven simultaneously with first member 40 through the loose medium 76 in response to forward movement 22 of rod 12. As shown in FIG. 2, a control mechanism 130 is carried on first member 40 and frictionally engages first member 40. The frictional engagement is such that first member 40 is movable relative to control mechanism 130 when movement of control mechanism 130 is limited or stopped. Control mechanism 130 controls the engagement and disengagement of the drive shoulders 92, 94 with the drive faces 122, 126 in a manner which will be explained later.

Referring to FIG. 2, the control mechanism 130 includes an annular ring 132 sleeved onto the first member 40. As will be explained later, annular ring 132 cooperates with the second member 50 to limit or stop movement of the control mechanism 130 to permit the first member 40 to move relative to the control mechanism 130. A cylindrical portion 134 of control mechanism 130 extends longitudinally from the annular ring 132. The cylindrical portion 134 is slightly tapered radially inwardly from the ring 132 toward its distal end 136 to provide frictional contact with the outer surface of first member 40. The cylindrical portion 134 includes two diametrically opposed generally rectangular shaped openings 138 which are elongated and open at the distal end 136 to receive bosses 86 on the external surface of first member 40 when the control mechanism is sleeved onto the first member 40. As will be noted more particularly in the description of the operation of the control mechanism 130, the longitudinal length of the cylindrical portion 134 is substantially equivalent to the longitudinal spacing between ridges 120 and 124 on the inner surface of the second member 50. The cylindrical portion 134 also includes two diametrically opposed tapered openings 140 which are elongated and open at the distal end 136 to receive the cam followers 110 on the drive shoulders 92, 94. Each tapered opening 140 includes diametrically opposed cam surfaces 142 for engaging the cam surfaces 112 of the cam followers 110 on the drive shoulders 92, 94. As shown in FIG. 2, the greatest spacing between the cam surfaces 142 in a tapered opening 140 is at the distal end 136 and the spacing becomes narrower toward the ring 132. Cam followers 110 follow cam surfaces 142 in response to movement of the first member 40 relative to the control mechanism 130 to move drive shoulders 92, 94 radially inwardly against the spring 98 and to permit radially outward movement of drive shoulders 92, 94 in response to the bias of spring 98. This action controls the engagement and disengagement of shoulders 92, 94 with drive faces 122, 126.

Figure 5:
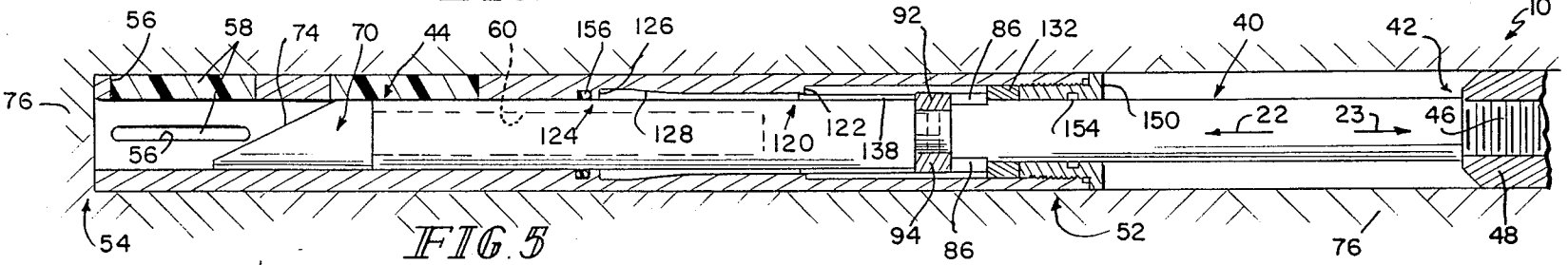
FIG. 5 is a longitudinal transverse view of the apparatus shown in FIG. 1 showing the position of the control assembly for disengaging the drive-engaging assembly and permitting the directing member to be enabled.
Figure 6:
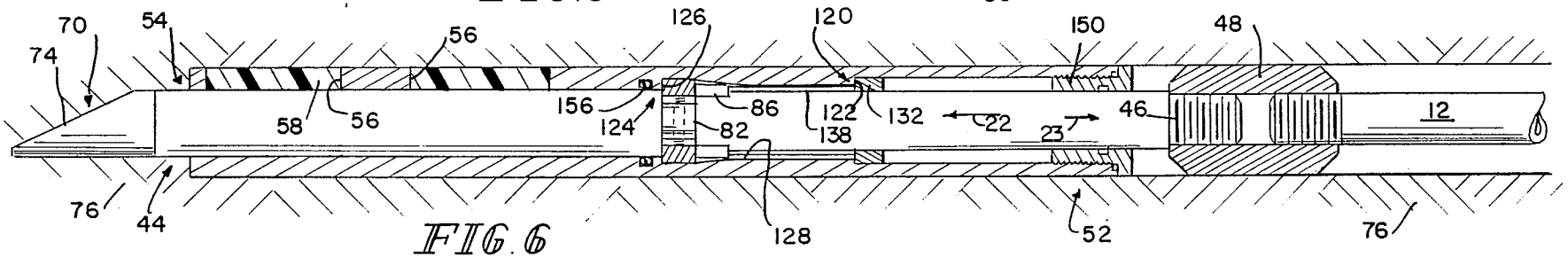
FIG. 6 is a longitudinal transverse view of the apparatus shown in FIG. 1 showing the directing member in its enabled position.

The operation of the rod-directing apparatus 10 can best be explained by referring to FIGS. 4, 5, and 6. In FIG. 4, rod-directing apparatus 10 is shown with the directing member 70 disabled and the first member 40 in driving engagement with the second member 50 (through drive shoulders 92, 94 and drive face 122) so that in response to forward movement 22 of rod 12, rod-directing apparatus 10 and rod 12 are moved through the loose medium 76 without being directed in any particular direction. In FIG. 5, rod-directing apparatus 10 is shown in an intermediate stage of operation for enabling the directing member 70. In FIG. 6, the rod-directing apparatus 10 is shown with the directing member 70 enabled and the first member 40 in driving engagement with the second member 50 (through drive shoulders 92, 94 and drive face 126) so that in response to forward movement 22 of the rod 12, the rod-directing apparatus 10 and rod 12 are moved in the direction of the sloped or inclined surface 74 of the directing member 70 through the loose medium 76.

As shown in each of FIGS. 4, 5, and 6, an end member 150 is threadably connected to the proximal end 52 of the second member 50. End member 150 includes an axially inwardly facing surface 152 spaced longitudinally from the drive face 122 a distance substantially equivalent to the longitudinal length of the entire control mechanism 130. Surface 152 provides a limit which engages annular ring 132 of control mechanism 130 to stop movement of control mechanism 130 when the first member 40 is moved rearward in response to backward movement 23 of rod 12. A sealing ring 154 is provided in the inner surface of end member 150 to provide a seal between the end member 150 and the first member 40 at the proximal end 52 of the second member 50. Another sealing ring 156 is provided in the inner surface of the second member 50 adjacent the annular ridge 124 to provide a seal between the second member 50 and the first member 40 in proximity to ridge 124. The seals 154 and 156 serve to create a sealed chamber in the second member 50 within which the drive shoulders 92, 94 and control mechanism 130 are operable. Within this sealed chamber, a lubricating fluid (not shown) may be included to facilitate operation of the drive shoulders 92, 94 and control mechanism 130.

Referring to FIG. 4, when directing member 70 is in its disabled position, it is withdrawn into the hollow interior of the second member 50, and drive shoulders 92, 94 engage the axially facing drive face 122 to provide a driving relationship between first member 40 and second member 50 for movement of rod-directing apparatus 10 in response to forward movement 22 of rod.

As shown in FIG. 4, when directing member 70 is disabled, annular ring 132 of control mechanism 130 is in proximity to the axially inwardly facing limit surface 152 of end member 150. Thus, cam followers 110 on drive shoulders 92, 94 are positioned in tapered openings 140 near the distal end 136 of the cylindrical portion 134 of control mechanism 130. Since the tapered openings 140 are widest near the distal end 136, the drive shoulders 92, 94 are biased radially outwardly toward the inner surface of the second member 50 to engage the axially facing drive face 122. When the directing member 70 is disabled, forward movement 22 of rod 12 is not directed in any particular direction. Thus, as rod 12 is moved through the loose medium 76, the intended course or path of movement is straight. However, because of differences in density in the loose medium 76 or obstacles, forward movement 22 of rod 12 may deviate from the intended straight course or path. In case of such deviation, it is necessary to be able to selectively direct forward movement 22 of rod 12 in a desired direction to bring forward movement 22 back onto the desired course or path.

Referring to FIG. 5, in order to enable the directing member 70 so that the forward movement 22 of the rod 12 can be directed in a desired direction, rod , 12 is pulled by pipe pusher 20 (shown in FIG. 1) causing rearward movement 23 of first member 40 relative to the second member 50. Rearward movement of second member 50 is restricted or prevented by friction between the outer surface of second member 50 and the loose medium 76. As rearward movement 23 of the first member 40 occurs, annular ring 132 engages the axially inwardly facing limit surface 152 to stop movement of the control mechanism 130. As rearward movement 23 of the first member 40 continues, cam surfaces 112 of cam followers 110 on drive shoulders 92, 94 follow the cam surfaces 142 of the control mechanism 130. As the cam surfaces 142 taper toward each other, drive shoulders 92, 94 are moved radially inwardly away from the inner surface of the second member 50 and into the chamber 80 against the bias of spring 98 to disengage the drive shoulders 92, 94 from the axially facing drive face 122. Drive shoulders 92, 94 are moved radially inwardly so that the distance between the radial outer surfaces of the drive shoulders 92, 94 is less than the internal diameter of the annular ridge 120 so that drive shoulders 92, 94 will move past ridge 120 in response to forward movement 22 of rod 12. In the intermediate stage of operation of the rod-directing apparatus 10 shown in FIG. 5, the apparatus 10 is now ready to be reengaged with the directing member 70 enabled to direct the rod 12 in a desired direction.

Referring to FIG. 6, from the intermediate stage shown in FIG. 5, rod 12 is again pushed by rod pusher 20 to cause forward movement 22 of first member 40. As the first member 40 is moved forward (forward movement 22), drive shoulders 92, 94 pass annular ridge 120 and the control mechanism 130 is carried in frictional engagement with the first member 40 in the relationship with drive shoulders 92, 94 as shown in FIG. 5 until the annular ring 132 engages the axially facing drive face 122 on annular ridge 120. Upon engagement of annular ring 132 with drive face 122, movement of the control mechanism 130 is stopped while forward movement 22 of the first member 40 continues. As the forward movement 22 of the first member 40 continues, cam surfaces 112 of the cam followers 110 on drive shoulders 92, 94 follow the cam surfaces 142 in the cylindrical portion 134 of control mechanism 130. As the drive shoulders 92, 94 are moved forward toward the distal end 136 of control mechanism 130, drive shoulders 92, 94 are permitted to move radially outwardly toward the inner surface of second member 50 in response to bias of spring 98 so that they engage the axially facing drive face 126 on the inner surface of the second member 50. As forward movement 22 of rod 12 and the first member 40 continues, the second member 50 is also driven. As shown in FIG. 6, when drive shoulders 92, 94 are engaged with the axially facing drive surface 126, directing member 70 is enabled to direct forward movement 22 of the rod 12 in the direction of the sloped surface 74 of directing member 70.

Once forward movement 22 of the rod 12 has been directed in a desired direction for a sufficient distance, it may again be desirable to disable the directing member 70. To disable the directing member 70 from its enabled position as shown in FIG. 6, pusher 20 (shown in FIG. 1) is again employed to pull rod 12, causing rearward movement 23 of the first member 40. As first member 40 is moved rearwardly 23, control mechanism 130 is again carried on the first member 40. Drive shoulders 92, 94 are compressed inwardly against the bias of spring 98 as they move along the ramp 128 on the inner surface of the second member 50 between ridges 120 and 124. Once the axially facing drive surfaces 100 of the drive shoulders 92, 94 have passed annular ridge 120, the drive shoulders 92, 94 are released to spring radially outwardly toward the inner surface of the second member 50 so that drive shoulders 92, 94 engage the axially facing drive face 122 in the position shown in FIG. 4. At this point, rearward movement 23 of rod 12 and first member 40 must stop. Otherwise, continued rearward movement 23 will cause ring 132 to engage face 152 and drive shoulders 92, 94 will be retracted by control mechanism 130 to a position as shown in FIG. 5. Since the apparatus 10 cannot be seen by the operator of pusher 20, a mark can be made on the rod 12 above the ground surface to provide an indication of the distance of travel of rearward movement 23. In this position, the directing member 70 is disabled and the control mechanism 130 is in position to enable the directing member 70 again if necessary.

Referring again to FIG. 1, the desired direction for forward movement of the rod 12 can be selectively determined by rotating the rod 12 using the power-driven apparatus 24, a hand-held rotating device, such as a wrench (not shown), or by hand which in turn rotates the rod-directing apparatus 10 in the loose medium to position the sloped surface or face 74 in a desired position for directing the rod 12 in the desired direction. In order for the operator to know which direction the sloped surface 74 is facing in the loose medium 76, some calibration should be provided on the pusher 20 or the power-driven apparatus 24 as an indication of the direction the sloped surface 74 is facing. Illustratively, as shown in FIG. 1, the power-driven apparatus 24 or the pusher 20 can include markings 158 indicating increments such as 90° of rotation of rod 12 with the uppermost marking indicating that the sloped surface 74 is facing up. With the sloped surface 74 facing up, the rod 12 and apparatus 10 will be directed downward in FIGS. 4–6.

Figure 7:
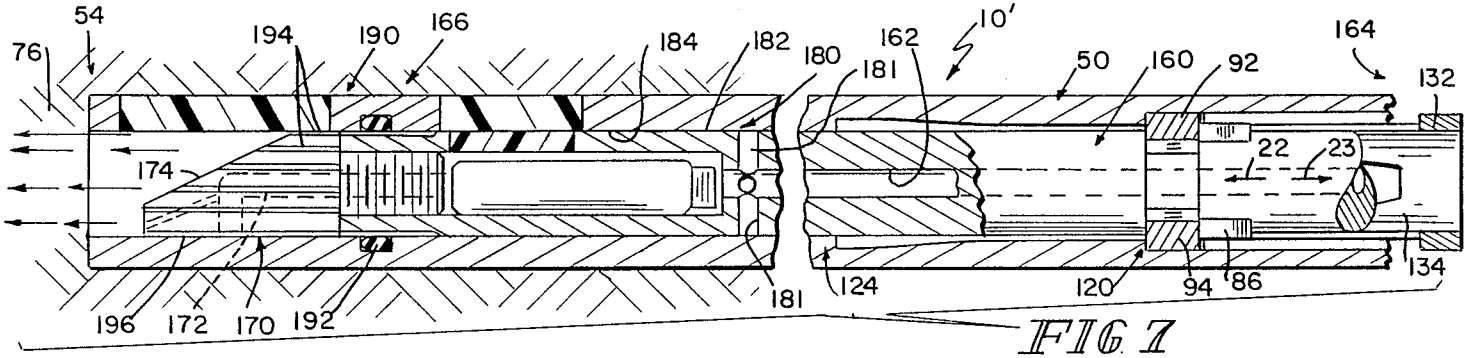
FIG. 7 is a fragmentary transverse view of another embodiment of the apparatus shown in FIG. 1 including apparatus for transmitting and dispensing a fluid in the direction of forward movement of the rod.
Figure 8:
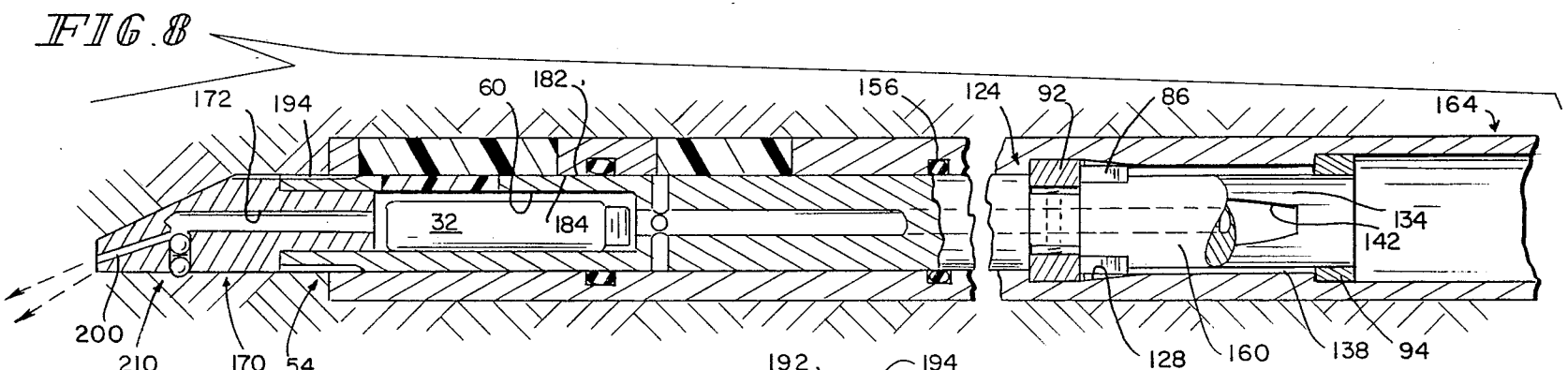
FIG. 8 is a fragmentary transverse view of the embodiment of the apparatus shown in FIG. 7 showing the directing member in its enabled position with fluid being dispensed in the direction of movement of the rod.
Figure 9:
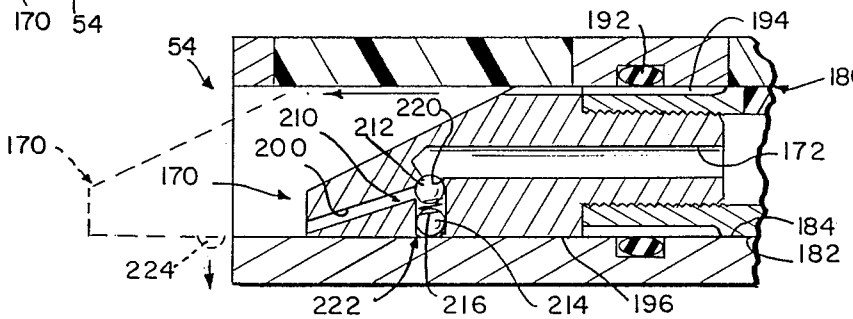
FIG. 9 is a transverse view of the distal end of the apparatus of FIG. 7 showing operation of the valve assemblies when the directing member is disabled and when the directing member is enabled.

Referring now to FIGS. 7, 8, and 9, it is sometimes desirable to condition the loose medium 76 through which a rod 12 is being moved to facilitate forward movement 22 of the rod 12. For example, it may be desirable to soften the loose medium 76. In this instance, it is desirable to dispense a fluid such as water or drilling mud under pressure into the loose medium 76 in front of the movement of the rod 12. In connection with the rod-directing apparatus 10 of the present invention, forward movement 22 of the rod 12 may be either undirected as shown in FIG. 7 or directed as shown in FIG. 8. In order to provide the fluid to the distal end 44 of the first member 40, a rod-directing apparatus 10' is shown in FIGS. 7, 8, and 9. In FIGS. 7, 8, and 9, the elements of rod-directing apparatus 10' which are identical to the elements of rod-directing apparatus 10 shown in FIGS. 1–6 have been given the same reference numerals. Elements that have been changed or added in rod-directing apparatus 10' have been given different reference numerals. Operation of rod-directing apparatus 10' is the same as rod-directing apparatus 10 except as otherwise described differently hereinafter.

In rod-directing apparatus 10', a first member 160 includes a first fluid passageway 162 extending longitudinally the length of first member 160 from its proximal end 164 to its distal end 166. Further, rod-directing directional apparatus 10' includes a directing member 170 that includes an extension 172 of the first fluid passageway 162. Thus, fluid is transmittable from the proximal end 164 of the first member 160 into the directional member 170 through first fluid passageway 162, 172.

First member 160 also includes a second fluid passageway 180 connected to the first fluid passageway 162. The second fluid passageway 180 includes one or more passageways 181 extending radially outwardly from the first fluid passageway 162 and opening on the outer surface 182 of the first member 160, permitting fluid to flow between the outer surface 182 of the first member 160 and the inner surface 184 of the second member 50. The annular seal 156 (shown in FIGS. 4–6) prevents the fluid from flowing backward into the chamber housing the drive shoulders 92, 94 and control mechanism 130. The second fluid passageway 180 including the extension thereof between the outer surface 182 of first member 160 and the inner surface 184 of the second member 50 serves to provide a nozzle for dispensing the fluid into the loose medium 76 when the directing member 170 is disabled as shown in FIGS. 7 and 9. This nozzle includes a valve assembly 190 for opening and closing the second fluid passageway 180 in response to forward movement 22 and rearward movement 23 of the first member 160.

As best shown in FIGS. 7 and 9, valve assembly 190 includes an annular sealing ring 192 in the inner surface 184 of the second member 50 which provides a seal with the outer surface 182 of the first member 160 when the directing member 170 is enabled as shown in FIG. 8. The seal between inner surface 184 of second member 50 and outer surface 182 of first member 160 closes the second fluid passageway 180 to prevent the dispensing of fluid through the nozzle. Bypass means 194 is provided on the outer surface 182 of the first member 160 and on the outer surface 196 of the directing member 170. In the illustrative embodiment, bypass means 194 includes a series of splines or channels cut in the outer surfaces 182 and 196 of the first member 160 and directing member 170, respectively, to permit fluid to flow past seal 192 when the directing member 170 is disabled as shown in FIG. 7. It will be understood that instead of a Plurality of individual splines or channels it may be possible to reduce the diameter of the first member 160 at its distal end 166 all around the circumference thereof and to reduce the diameter of the directing member 170 to correspond to the reduced diameter of the distal end 166.

Therefore, as can be seen in FIGS. 7, 8, and 9, when the directing member 170 is disabled, fluid is permitted to flow through second fluid passageway 180 past seal 192 and is dispensed in the direction of forward movement 22 as indicated by the arrows at the distal end 54 of the second member 50. However, when the directing member 170 is enabled as shown in FIG. 8, seal 192 provides a seal between the outer surface 182 of the first member 160 and the inner surface 184 of the second member 50 to close the second fluid passageway 180 and prevent fluid from being dispensed through the second fluid passageway 180.

Referring to FIGS. 8 and 9, the directing member 170 includes a third fluid passageway 200 connected to the extension 172 of the first fluid passageway 162. The third fluid passageway 200 extends from the extension 172 of the first fluid passageway 162 in spaced parallel relationship to the slope of the sloped surface 174 of the directing member 170. The second fluid passageway 200 serves to provide another nozzle for dispensing fluid in the direction of forward movement 22 as the rod 12 is directed by the directing member 170. The nozzle in directing member 170 includes another valve assembly 210 for closing the third fluid passageway 200 when the directing member 170 is disabled as shown in FIG. 9. and for opening the third fluid passageway 200 when the directing member 170 is enabled as shown in FIG. 8. Valve assembly 210 includes a first ball 212, a second ball 214, and a compression spring 216 between the first ball 212 and the second ball 214 biasing the balls 212, 214 away from each other. The balls 212, 214 and the spring 216 are contained in cavity 218 opening into first and third fluid passageways 162 and 200 and opening outwardly through the outer surface 196 of directing member 170. In the disabled position of the directing member 170, as best seen in FIG. 9, first ball 212 is seated against a valve seat 220 provided at the interconnection of the first fluid passageway 162, 172 and the third fluid passageway 200 and ball 214 is compressed toward ball 212 by the inner surface 184 of the second member 50, thereby forcing the first ball 212 against the valve seat 220 to close the third fluid passageway 200.

As the directing member 170 is moved forward to its enabled position as shown in FIG. 8 and in broken lines in FIG. 9, the pressure applied by the inner surface 184 of the second member 50 is released as the ball 214 passes beyond the distal end 54 of the second member 50, thereby permitting the ball 212 to be unseated from seat valve 220 so that fluid can flow through the third passageway 200 and be dispensed from the end of the directing member 170 in the direction of forward movement of the rod 12, as shown by the arrows in FIG. 8. Although not specifically shown in FIGS. 7, 8, or 9, it will be appreciated that ball 214 is retained in the cavity 218 in the directing member 170 when it passes the distal end 54 of the second member 50 by a retaining lip or ridge 222 at the edge of the opening of the cavity 218 containing the balls 212, 214.

In operation, when the directing member 170 is disabled as shown in FIG. 7, fluid flows through second fluid passageway 180 and bypasses the seal 192 so that it is dispensed through the distal end 54 of the second member 50 and at the same time ball 212 is seated on valve seat 220 and so that the third fluid passageway 200 is closed. When the directing member 170 is enabled as shown in FIG. 8, seal 192 provides a seal between the outer surface 182 of first member 160 and the inner surface 184 of second member 50 to close the second fluid passageway 180 and ball 214 is released as shown in FIGS. 8 and 9 to permit ball 212 to be unseated from valve seat 220 and thereby to permit fluid to pass through third fluid passageway 200 and to be dispensed in the direction of movement of the rod 12.

Although the invention has been described in detail with reference to certain preferred embodiments, variations and modifications exist within the scope and spirit of the invention as described and defined in the following claims.

What is claimed is:

1. An apparatus for directing the forward movement of a rod as it is moved through a loose medium comprising a first member having a proximal end and a distal end, a second member sleeved onto the first member so that the first member is movable relative to the second member, means or coupling the proximal end of the first member to the rod so that movement of the rod moves the first member, means provided on one of the first and second members for directing movement of the rod, means providing at least one drive shoulder on the first member, means providing a first drive face on the second member, means for yieldably biasing the drive shoulder toward the second member to engage the first drive face on the second member in a first drive position wherein the directing means is disabled so that forward movement of the rod is not directed as it is moved through the loose medium, means providing a second drive face on the second member, and means for controlling the drive shoulder to disengage the first drive face and to engage the second drive face on the second member in a second drive position wherein the directing means is enabled to direct forward movement of the rod in a desired direction as it is moved through the loose medium.

2. The apparatus as recited in claim 1 wherein the drive shoulder includes means providing a cam follower, the control means includes means providing a cam surface engaging the cam follower to move the drive shoulder against the biasing means toward the first member to disengage the drive shoulder from the first drive face and to permit the drive shoulder to move toward the second member in response to the biasing means to engage the second drive face.

3. The apparatus as recited in claim 2 wherein the control means is carried on the first member in slidable engagement therewith and the apparatus further includes limit means on the second member for engaging the control means to stop rearward movement of the control means in response to rearward movement of the first member, whereby rearward movement of the first member can continue relative to the control means and the cam follower on the drive shoulder follows the cam surface on the control means to move the drive shoulder toward the first member to disengage the first drive face.

4. The apparatus as recited in claim 3 wherein the control means includes a flange for engaging the limit means on the second member and for engaging the first drive face to stop forward movement of the control means in response to forward movement of the first member, whereby forward movement of the first member can continue relative to the control means and the cam follower on the drive shoulder follows the cam surface on the control means to permit movement of the drive shoulder toward the second member in response to the biasing means to engage the second drive face.

5. The apparatus as recited in claim 4 wherein the directing means is provided on the distal end of the first member and is disabled when the drive shoulder engages the first drive face and is enabled to direct forward movement of the rod when the drive shoulder engages the second drive face.

6. The apparatus as recited in claim 5 wherein the directing means includes a sloped surface to direct the forward movement of the rod in the direction of the slope.

7. The apparatus as recited in claim 1 further including means in the distal end of one of the first and second members for transmitting a signal indicating position and depth of the distal end in the loose medium.

8. The apparatus as recited in claim 1, further including means providing a first fluid passageway in the first member for transmitting a fluid from the proximal end to the distal end of the first member, first nozzle means provided at the distal end of the first member for dispensing the fluid into the loose medium when the directing means is disabled, second nozzle means provided in the directing means for dispensing the fluid in the desired direction of forward movement of the rod when the directing means is enabled.

9. The apparatus as recited in claim 8 wherein the first nozzle means includes means providing a second fluid passageway connected to the first fluid passageway for dispensing the fluid into the loose medium and wherein the second nozzle means includes means providing a third fluid passageway connected to the first fluid passageway for dispensing the fluid into the loose medium.

10. The apparatus as recited in claim 9, further including first valve means for closing the second fluid passageway when the directing means is enabled and for opening the second fluid passageway when the directing means is disabled.

11. The apparatus as recited in claim 10, further including second valve means for closing the third fluid passageway when the directing means is disabled and for opening the third fluid passageway when the directing means is enabled.

12. The apparatus as recited in claim 11 wherein the first valve means includes sealing means for closing the second fluid passageway and bypass means for bypassing the sealing means to open the second fluid passageway.

13. The apparatus as recited in claim 9 wherein the directing means includes a sloped surface to direct the forward movement of the rod in the direction of the slope and wherein the third fluid passageway is substantially parallel to the sloped surface whereby the fluid is dispensed into the loose medium in the direction of the forward movement of the rod.

14. An apparatus for directing the forward movement of a rod as it is moved through a loose medium comprising a first member having a proximal end and a distal end, a second member sleeved onto the first member so that the first member is movable relative to the second member, the second member having a distal end and a proximal end, means for coupling the proximal end of the first member to the rod so that movement of the rod moves the first member, means provided on one of the first and second members for directing forward movement of the rod, drive-engaging means provided on the first and second members for engaging the first member in a first drive position relative to the second member wherein the directing means is disabled so that forward movement of the rod is not directed and for engaging the first member in a second drive position relative to the second member wherein the directing means is enabled so that forward movement of the rod is directed, and means for controlling the drive-engaging means to disengage and engage the first member in the first and second drive positions selectively to direct the forward movement of the rod in a desired direction as it is moved through the loose medium.

15. An apparatus for directing the forward movement of a rod as it is moved through a loose medium, comprising a first member having a proximal end and a distal end, a second member sleeved onto the first member so that the first member is movable relative to the second member, the second member having a proximal end and a distal end, means for coupling the proximal end of the first member to the rod so that movement of the rod moves the first member, means provided on one of the first and second members for directing forward movement of the rod, drive-engaging means provided on the first and second members for engaging the first member in a first drive position relative to the second member wherein the directing means is disabled so that forward movement of the rod is not directed and for engaging the first member in a second drive position relative to the second member wherein the directing means is enabled so that forward movement of the rod is directed, means for controlling the drive-engaging means to disengage and engage the first member in the first and second drive position selectively to direct the forward movement of the rod in a desired direction as it is moved through the loose medium, means providing a first fluid passageway in the first member for transmitting a fluid from the proximal end to the distal end of the first member, first nozzle means for dispensing the fluid into the loose medium when the directing means is disabled, and second nozzle means for dispensing the fluid in the desired direction of the forward movement of the rod when the directing means is enabled.

16. The apparatus as recited in claim 15 wherein the first nozzle means includes means providing a second fluid passageway connected to the first fluid passageway for dispensing the fluid into the loose medium and wherein the second nozzle means includes means providing a third fluid passageway connected to the first fluid passageway for dispensing the fluid into the loose medium.

17. The apparatus as recited in claim 16, further including first valve means for closing the second fluid passageway when the directing means is enabled and for opening the second fluid passageway when the directing means is disabled.

18. The apparatus as recited in claim 17, further including second valve means for closing the third fluid passageway when the directing means is disabled and for opening the third fluid passageway when the directing means is enabled.

19. The apparatus as recited in claim 18, wherein the first valve means includes sealing means for closing the second fluid passageway and bypass means for bypassing the sealing means to open the second fluid passageway.

20. The apparatus as recited in claim 16, wherein the directing means includes a sloped surface to direct the forward movement of the rod in the direction of the slope and wherein the third fluid passageway is substantially parallel to the sloped surface whereby the fluid is dispensed into the loose medium in the direction of the forward movement of the rod.

* * * * *